US009994778B2

(12) United States Patent
Bauman et al.

(10) Patent No.: US 9,994,778 B2
(45) Date of Patent: Jun. 12, 2018

(54) DIRECT COAL LIQUEFACTION PROCESS AND SYSTEM

(71) Applicant: Accelergy Corporation, Houston, TX (US)

(72) Inventors: Richard F Bauman, Blllingham, WA (US); Richard P O'Connor, Flat Rock, NC (US); Peter S Maa, Sugar Land, TX (US)

( * ) Notice: Subject to any disclaimer, the term of this patent is extended or adjusted under 35 U.S.C. 154(b) by 58 days.

(21) Appl. No.: 15/162,385

(22) Filed: May 23, 2016

(65) Prior Publication Data

US 2016/0340592 A1 Nov. 24, 2016

Related U.S. Application Data

(60) Provisional application No. 62/165,991, filed on May 24, 2015, provisional application No. 62/165,993, filed on May 24, 2015.

(51) Int. Cl.

| | |
|---|---|
| ***C10G 1/00*** | (2006.01) |
| ***C10G 7/06*** | (2006.01) |
| ***C10G 1/08*** | (2006.01) |

(52) U.S. Cl.

CPC ..... *C10G 7/06* (2013.01); *C10G 1/002* (2013.01); *C10G 1/083* (2013.01); *C10G 1/086* (2013.01)

(58) Field of Classification Search

CPC ..... C10G 1/002; C10G 1/06; C10G 1/083; C10G 1/086; C10G 7/06

See application file for complete search history.

(56) References Cited

U.S. PATENT DOCUMENTS

| | | | | |
|---|---|---|---|---|
| 4,025,318 | A * | 5/1977 | Moody | C10G 47/00 252/373 |
| 4,473,460 | A | 9/1984 | Kuerten et al. | |
| 4,666,589 | A | 5/1987 | Klein et al. | |
| 4,944,866 | A | 7/1990 | Fuhrmann et al. | |
| 2013/0104611 | A1 * | 5/2013 | Bauman | C05F 11/00 71/1 |
| 2015/0191657 | A1 | 7/2015 | Bauman et al. | |

OTHER PUBLICATIONS

Graeser, et. al. Upgrading of coal Derived Oil by Integrating Hydrotreatment tothe Primary Liquefaction Step, Am. Chem. Soc., Div. Gas Fuel Chem., Journal vol. 33.1, Jun. 5, 1988.

* cited by examiner

*Primary Examiner* — Brian A McCaig

(57) ABSTRACT

A direct coal liquefaction process and system is provided that utilizes a dispersed catalyst and recycle of atmospheric and vacuum fractionator bottoms to produce a maximum yield of jet fuel/diesel or chemical plant feedstock while eliminating all slurry heat exchangers and a slurry preheat furnace. Process hydrogen is preheated in a heat exchanger and, if necessary, in a hydrogen furnace, and mixed with the recycled atmospheric and vacuum fractionator bottoms being fed to the input of the direct liquefaction reactor. Heat for the hydrogen heat exchanger is provided by the overhead from the hot separator receiving the effluent from the direct liquefaction reactor. Product selectivity is controlled by operating conditions.

14 Claims, 1 Drawing Sheet

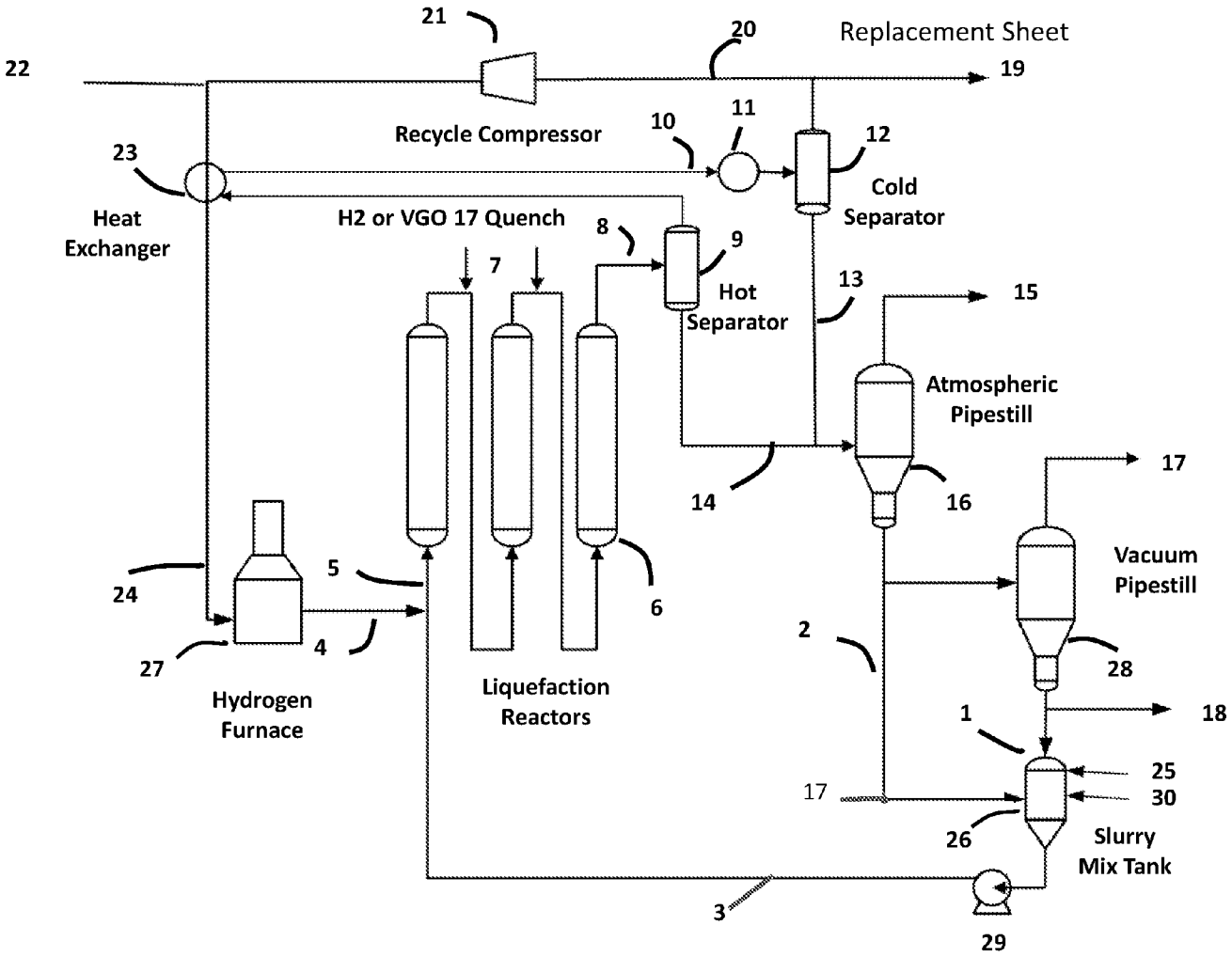
Replacement Sheet
19
20
21
22
Recycle Compressor
10
11
12
Cold Separator
13
9
Hot Separator
8
H2 or VGO 17 Quench
7
6
Liquefaction Reactors
14
15
Atmospheric Pipestill
16
17
Vacuum Pipestill
28
18
2
17
1
25
30
Slurry Mix Tank
26
29
3
5
4
Hydrogen Furnace
27
24
23
Heat Exchanger

DIRECT COAL LIQUEFACTION PROCESS AND SYSTEM

FIELD OF THE INVENTION

This invention relates to direct coal liquefaction (DCL) processes and systems for conversion of coal containing solid carbonaceous material via hydrogenation into fuels and chemical products. The coal liquefaction reaction takes place at 100 to 1,000 bars and 400 to 520° C.

BACKGROUND OF THE INVENTION

In the DCL process, coal is typically slurried with a process derived solvent and pumped up to operating pressure. Typically, the slurry is heated to operating conditions via a heat exchanger or a fired furnace. The heat for heat exchange is typically provided by the heat of reaction during coal liquefaction. In some processes, additional heat is released within the process by the preparation of partially hydrogenated solvent (Donor Solvent) and/or during the upgrading of the liquefaction products to remove sulfur, nitrogen, and oxygen.

Historically, in known DCL processes, the ratio between coal and slurry has been maximized. E.g., U.S. Pat. No. 4,944,866 states "In processes using only process derived products as slurry one objective is to increase the ratio between the coal and slurry as much as possible, in order to keep the expensive reaction space of the liquid phase hydrogenation low".

Slurry preheat furnaces are used in many patented processes. They are required because the temperature of the mixed slurry is limited because of low proportion of hot process derived solvent relative to the quantity of ambient temperature coal. In addition, processes utilizing a Donor Solvent and/or a low activity catalyst require preheat to temperatures approaching liquefaction conditions to initiate the liquefaction reaction. The combination of these factors results in a requirement for large expensive, preheat furnaces.

An additional problem with the use of slurry preheat furnaces is discussed in "Upgrading of Coal Derived Oil by Integrating Hydrotreatment to the Primary Liquefaction Step" by Graeser, et. al., where it is stated that a fired slurry pretreater system "was very sensitive against deposit and coke formation, especially at the high temperature prevailing in the preheater tubes".

Similarly, in U.S. Pat. No. 4,666,589, the authors state "It is also known that the coal-oil slurry of finely ground coal and the slurry oil, which is a recycle distillate stream from the operation of a coal liquefaction process, undergoes a swelling stage during heating". And further, "A great increase in viscosity occurs in the section as a result of the swelling process between the initial heat exchangers for the slurry and the hydrogen gas mixture and the preheater. The increase in viscosity can cause a considerable pressure drop in the absence of special precautions". In addition, the authors state "When heating the three phase mixture of the coal/oil slurry in the presence of hydrogen-containing gas, sedimentation of the solid components can occur in the heat exchanger pipes of the preheater". In this patent, the inventors propose using a combination of heat exchangers and furnaces for preheating both the hydrogenation gas and the slurry. In U.S. Pat. No. 4,473,460, a flow scheme is described that utilizes multiple heat exchangers for preheating the slurry and hydrogen during normal operations, without a slurry preheat furnace, for preheating the reactants to coal liquefaction reactor temperature. In this particular scheme, heat is generated from both liquefaction and upgrading.

SUMMARY OF THE INVENTION

The present invention is an improvement of the process described in U.S. application Ser. No. 14/147,542 (WO 2014/110085 A1), the content of which is incorporated herein by reference in its entirety.

In accordance with the present invention, a sufficient amount of a 600 to 700° F.+(316 to 371° C.+)(nominally 650° F.+) fraction from an Atmospheric Pipestill (APS), and a 650 to 950/1100° F. (343 to 510/593° C.−)(nominally 650 to 1000° F.) fraction from a Vacuum Pipestill (VPS) are mixed with the feed coal in the slurry mix tank such that the temperature of the slurry is at least 600° F. (316° C.). The nominal 650 to 1000° F. fraction from the VPS is frequently referred to as vacuum gas oil or VGO.

Slurry from the slurry mix tank is mixed with hydrogen that has been preheated to a temperature such that the combined slurry/hydrogen feed to the liquefaction reactor is at a temperature of at least about 660° F. (349° C.), and preferably at between 660 and 700° F. (349-371° C.). This process flow arrangement has the very important advantage of eliminating the need for a slurry heat exchanger or slurry preheater, thereby eliminating high surface area slurry heat exchangers, high surface area preheat furnaces, problems with coking and solids deposition, and increased cost.

Alternatively, VGO may also be used for quench in the liquefaction reactors in place of the normal hydrogenation gas. This eliminates the need for compression of additional treat gas between liquefaction reactors and also lowers the superficial gas velocity in the reactors, thus reducing the gas hold-up in the reactors. In an alternate configuration, part of the VGO can be removed as product A further alternative is to use both VGO and $H_2$ rich treat gas for quench. In all of the above cases, the VPS should be sized to produce a bottoms purge stream to remove ash from the system.

In accordance with another aspect of the invention, VPS bottoms (1,000 to 1,100° F.+) can also be recycled to the slurry mix tank to provide sufficient heat to contribute to raising the slurry mix tank temperature to at least 600° F. plus increase the catalyst concentration at the liquefaction reactor inlet.

BRIEF DESCRIPTION OF THE DRAWINGS

FIG. 1 is a schematic diagram of a direct coal liquefaction system suitable for use in the illustrated embodiment of the invention.

DETAILED DESCRIPTION OF ILLUSTRATED EMBODIMENT

The DCL process of this invention achieves high coal conversion and liquid yields without the need for either slurry heat exchangers or slurry preheat furnace. All heat input to liquefaction, as illustrated in FIG. 1, is achieved by recycle of APS bottoms and VGO and a hydrogen treat gas heat exchanger and preheat furnace.

An embodiment of a reactor system for performing the direct coal containing solid carbonaceous material liquefaction in accordance with the invention is shown in FIG. 1. The coal feed is dried and crushed in a conventional gas swept roller mill (not shown) to a moisture content of 1 to 4%. The crushed and dried coal 25 and a dispersed catalyst 30 are fed into a slurry mixing tank 26 where they are mixed with a 600 to 700° F.+(316 to 371° C.+)(nominally 650° F.+) fraction 2 from the APS 16 and optionally a portion of the bottoms 1 from the VPS 28 (also referred to more generally as atmospheric and vacuum fractionators, respectively) and with VGO from line 17 to form a slurry stream.

The catalyst in the illustrated embodiment is preferably in the form of a 2-10% aqueous water solution of phosphomolybdic acid (PMA) in an amount that is equivalent to adding between 50 wppm and 2% molybdenum relative to the dry coal feed.

In the slurry mix tank 26, the contents are agitated for about 10 to 100 minutes and preferably for 20 to 60 minutes at an agitator speed defined a priori as a function of the slurry rheology. The slurry mix tank operating temperature is set by controlling the relative amounts of the nominal 650° F.+ fraction 2 from the APS 16, VPS bottoms, and VGO being fed thereto. Typical operating temperature ranges from 500 to 700° F. (260 to 371° C.) and more preferably about 600° F. (316° C.). From the slurry mix tank, the catalyst containing slurry is delivered to the slurry pump 29. The selection of the appropriate mixing conditions is based on experimental work quantifying the rheological properties of the specific slurry blend being processed.

In the illustrated embodiment, the slurry leaves the mixing tank 26 at about 600° F. (316° C.). Most of the remaining moisture in the coal is driven off in the mixing tank 26 due to the hot bottoms being fed thereto. Such moisture and volatiles are sent to separation. The coal in the slurry leaving the slurry mixing tank 26 has about 0.1 to 1.0% moisture.

The coal slurry is pumped from the mixing tank 26 and the pressure raised to about 2,000 to 3,000 psig (138 to 206 kg/cm$^2$ g) by the slurry pumping system 29. The resulting high pressure slurry is mixed with preheated hydrogen rich treat gas. The hydrogen treat gas is preheated in heat exchanger 23 and, if necessary, in preheat furnace 27. Heat for the hydrogen exchanger comes from the overhead from hot separator 9. Heat exchanger 11 can be an air or water cooled exchanger.

The coal slurry and hydrogen mixture is fed to the input 5 of the first stage of the series-connected liquefaction reactors 6 at about 660 to 700° F. (349 to 371° C.) and 2,000 to 3,000 psig (138 to 206 kg/cm$^2$g). The reactors 6 are up-flow tubular vessels, the total length of the three reactors being 50 to 250 feet. The temperature rises from one reactor stage to the next as a result of the highly exothermic coal liquefaction reactions. In order to maintain the maximum temperature in each stage below about 800 to 900° F. (427 to 482° C.), additional hydrogen treat gas 7 is preferably injected between reactor stages. The hydrogen partial pressure in each stage is preferably maintained at a minimum of about 1,000 to 2,000 psig (69 to 138 kg/cm$^2$g).

The effluent from the last stage of liquefaction reactor 6 is fed to the hot separator 9 in which it is separated into a gas stream and a liquid/solid stream. The gas stream is sent to the heat exchanger 23 in which it serves, together with the hydrogen furnace 27, to preheat the hydrogen being fed to the liquefaction reactors 6. The liquid/solid stream from the hot separator 9 is let down in pressure and fed to the APS 16 by feed line 14. After passing through the heat exchanger 23, the gas stream from the hot separator 9 is cooled in heat exchanger 11 and fed to the cold separator 12 to condense out the liquid vapors of naphtha, distillate, and solvent and processed to remove $H_2S$ and $CO_2$. Most of the remaining processed gas from the cold separator 12 is then sent to the hydrogen recovery system 21 for further processing by conventional means to recover the hydrogen contained therein, which is then recycled via the heat exchanger 23 and the hydrogen furnace 27 to be mixed with the coal slurry. The remaining portion of the processed gas is purged to prevent buildup of light ends in the recycle loop. Hydrogen recovered therefrom can be used in the downstream hydroprocessing upgrading system. Make-up hydrogen is added on line 22 to maintain an adequate hydrogen partial pressure in the liquefaction reactors.

The depressurized liquid/solid stream and the hydrocarbons condensed during the gas cooling are sent to the APS 16 where they are separated into light ends, naphtha, distillate and bottoms fractions. The light ends are processed to recover hydrogen and $C_1$-$C_4$ hydrocarbons that can be used for fuel gas and other purposes. The naphtha is hydrotreated to saturate diolefins and other reactive hydrocarbon compounds. The 160° F.+ fraction of the naphtha can be hydrotreated and catalytically reformed to produce gasoline. The distillate fraction can be hydrotreated to produce products such as diesel and jet fuel. A portion of the 600 to 700° F.+(316 to 371° C.+)(nominally, 650° F.+(343° C.+)) fraction is recycled to the slurry mix tank 26 on line 2. The 600 to 700° F.− (316 to 371° C.−)(nominally, 650° F.− (343° C.+)) light ends, naphtha and distillate fractions are taken off the APS 16 on lines indicated schematically as line 15.

The remaining nominal 650° F.+(343° C.+) fraction produced from the atmospheric fractionator 16 is fed to the VPS 28 wherein it is separated into a nominal 650 to 950/1100° F. (343 to 510/593° C.) VGO fraction and a 950/1100° F.+(510/593° C.+) bottoms fraction (nominally 650 to 1000° F. (343 to 538° C.) and 1000° F.+(538° C.+) fractions). At least a portion of the VGO fraction on line 17 is added to the nominal 650° F.+(343° C.+) stream from the APS being recycled to the slurry mix tank 26. Depending on the ash content of the coal being processed, a portion of the bottoms fraction from the VPS 28 can sent to the slurry mix tank 26 for being recycled to the first stage of the liquefaction reactor 6. This has the advantage that the catalyst entrained in such recycled bottoms is also thereby recycled to the reactor 6. Some or all of the VPS bottoms are sent on line 18 to remove ash from the system and used to generate hydrogen, for road paving, or as fuel in a cement plant.

The APS 16 is preferably operated at a high enough pressure so that a portion of the nominal 650° F.+(343° C.+) fraction can be recycled to the slurry mixing tank 26 without pumping.

Additional hydrogen for the process can also be produced via steam reforming of natural gas or via gasification of coal.

Example 1

This example is a computer simulation of the invention for a bituminous coal being liquefied at an EIT (equivalent isothermal temperature) of 800° F. and a feed to the slurry mix tank composed of a 2/1 weight ratio of 650° F.+/dry feed coal. Cold hydrogen treat gas is used for cooling between liquefaction reactors. Feed to the slurry mix tank include dried coal, 650° F.+(343° C.+) bottoms, and VGO from the VPS. The resulting mix temperature is 611° F.

| | Temperature | |
|---|---|---|
| Slurry Mix Tank | ° F. | (° C.) |
| Feed | | |
| Coal | 70 | (21) |

-continued

| Slurry Mix Tank | Temperature ° F. | (° C.) |
|---|---|---|
| 650° F.+ | 813 | (434) |
| 650/1000° F. from VPS | 349 | (176) |
| Outlet | 611 | (322) |

In order to raise the liquefaction inlet temperature to a minimum of 660° F., a small amount of additional heat is required from the hydrogen preheat furnace. Raising the liquefaction temperature or the 650° F.+ recycle rate will eliminate the need for the furnace during normal operations for this coal and conversion level.

| | Temperature ° F. | (° C.) |
|---|---|---|
| H2 Furnace | | |
| Inlet from heat exchanger | 770 | (410) |
| Furnace outlet | 816 | (436) |
| Temperature increase | 46 | (26) |
| Reactor Inlet Feed | | |
| Slurry from mix tank | 611 | (322) |
| H2 from furnace | 816 | (436) |
| Reactor Feed | 660 | (349) |

A preheat temperature of 660° F. is sufficient to kick off the liquefaction reaction because of the high activity dispersed catalyst present in the reactor from both make-up catalyst and catalyst recycled in the APS bottoms. Cold hydrogen treat gas (120° F.) is added between liquefaction reactors to limit the maximum reactor temperature to 820° F. in this example. Higher reactor temperatures (EIT) are possible by adding less cold hydrogen treat gas.

Example 2

This example is a computer simulation of the invention for a bituminous coal being liquefied at a EIT (equivalent isothermal temperature) of 800° F. and a feed to the slurry mix tank composed of a 3/1 weight ratio of 650° F.+/dry feed coal. Cold 650/1000° F. VGO from the vacuum distillation tower is used for cooling between liquefaction reactors.

Feed to slurry mix tank include dried coal, 650° F.+ bottoms, and VGO from the VPS. The resulting mix temperature is 615° F.

| Slurry Mix Tank | Temperature ° F. | (° C.) |
|---|---|---|
| Feed | | |
| Coal | 70 | (21) |
| 650° F. + bottoms | 777 | (414) |
| 650/1000° F. from VPS | 504 | (262) |
| Outlet | 615 | (324) |

Because of the higher temperature in the slurry mix tank and the increased rate of hydrogen treat gas (treat gas normally used for quench is added at the inlet), the hydrogen furnace is not required for preheat during normal operations with this coal and coal conversion level.

| | Temperature ° F. | (° C.) |
|---|---|---|
| H2 Furnace | | |
| Inlet from heat exchanger | 770 | (410) |
| Furnace outlet | 770 | (410) |
| Temperature increase | 0 | 0 |
| Reactor Inlet Feed | | |
| Slurry from mix tank | 615 | (324) |
| H2 from furnace | 770 | (410) |
| Reactor Feed | 660 | (349) |

Cold overhead VGO from the VPS is used in this example. The VGO is used in place of the cold hydrogen treat gas used in Example 1. Maximum reactor temperature is limited to 820° F. in this example also.

Example 3

In the first two examples, an average liquefaction temperature (EIT) of 800° F. was used for modeling. This requires a high recycle treat gas or 650/1000° F. rate to limit the temperature rise. Operation at a higher liquefaction temperature will further reduce the need for a hydrogen furnace.

What is claimed is:

1. Apparatus for converting a coal containing solid carbonaceous material feed into liquid fuels, comprising:

a. a direct coal liquefaction reactor for directly converting such solid carbonaceous material at elevated temperatures and pressures in the presence of a solvent and a catalyst for producing hydrocarbon products;

b. an atmospheric fractionator for separating hydrocarbon products of said direct liquefaction reactor into different boiling point fractions, including a nominal 650° F.+ (343° C.+) fraction;

c. a vacuum fractionator for separating a portion of said 650° F.+fraction from the atmospheric fractionator into fractions including a nominal 650° F. to 1000° F. (343° C. to 538° C.) fraction;

d. a slurry mix tank for mixing a portion of said nominal 650° F.+ (343° C.+) fraction from said atmospheric fractionator and at least a portion of said nominal 650° F. to 1000° F. (538° C.) fraction from said vacuum fractionator with feed coal containing solid carbonaceous material to form a slurry;

e. a pump and conduit for feeding slurry produced in the slurry mix tank directly to the input of said direct liquefaction reactor; and f. a heat exchanger connected to receive hydrogen recycled from said direct liquefaction reactor and/or makeup hydrogen for preheating such received hydrogen separately from said slurry and connected to the input of the direct liquefaction reactor for feeding the preheated hydrogen thereto for raising the temperature of the combined slurry and hydrogen being fed to the input of the direct liquefaction reactor to at least about 660° F.

2. The apparatus of claim 1 wherein said catalyst includes dispersed molybdenum.

3. The apparatus of claim 1 wherein said heat exchanger includes a hydrogen preheat furnace for preheating the hydrogen being fed to the input of the direct liquefaction reactor.

4. The apparatus of claim 1 wherein said heat exchanger heats said hydrogen sufficiently to raise the temperature of the combined slurry and hydrogen being fed to the input of the direct liquefaction reactor to between 660 and 700° F. (349 and 371° C.).

5. The apparatus of claim 1 wherein said direct liquefaction reactor includes a plurality of series connected reactor stages, and further including a conduit for feeding a portion of said nominal 650° F. to 1000° F. (343° C. to 538° C.) fraction between said reactor stages as a quench.

6. A method for converting a coal containing solid carbonaceous material to liquid fuels, comprising the steps of:

a. directly converting such solid carbonaceous material at elevated temperatures and pressures in the presence of a solvent and a catalyst in a direct liquefaction reactor for producing hydrocarbon products;

b. separating such hydrocarbon products into different boiling point fractions, including a nominal 650° F.+ (343° C.+) fraction c. separating a portion of said nominal 650° F.+ (343° C.+) fraction into fractions including a nominal 650° F. to 1000° F. (343° C. to 538° C.) fraction;

d. mixing a portion of said nominal 650° F.+ (343° C.+) fraction and at least a portion of said nominal 650° F. to 1000° F. (343° C. to 538° C.) fraction with said solid carbonaceous material to form a slurry;

e. pumping said slurry directly to the input of said direct liquefaction reactor; and f. combining said pumped slurry with hydrogen that has been heated separately from said slurry to a temperature such that the temperature of the combined slurry and hydrogen being fed to the input of the direct liquefaction reactor to at least about 660° F. (349° C.), wherein the only heat provided to the slurry pumped to the input of said direct liquefaction reactor is from the separately heated hydrogen.

7. The method of claim 6 wherein said catalyst includes dispersed molybdenum.

8. The method of claim 6 wherein the effluent from the direct liquefaction reactor is separated into a gas stream and a liquid/solid stream, and further including heating the hydrogen being fed to the input of said liquefaction reactor by heat exchange with said gas stream.

9. The method of claim 6 including further heating the hydrogen being fed to the input of said liquefaction reactor in a furnace.

10. The method of claim 6 wherein said catalyst is formed in situ in said liquefaction reactor from a phosphomolybdic acid feed.

11. The method of claim 6 wherein said direct liquefaction reactor comprises a three or more stage series connected adiabatic, slurry reactor, and further including controlling the temperatures of the reactor stages by supplying a hydrogen quench between the said reactor stages.

12. The method of claim 6 wherein the temperature of the combined slurry and hydrogen being fed to the input of the direct liquefaction reactor is between 660° and 700° F. (349 and 371° C.).

13. The method of claim 6 wherein said reactor includes a plurality of series connected reactor stages, and further including feeding a portion of said 650° F. to 1000° F. (343° C. to 538° C.) fraction between said reactor stages as a quench.

14. Apparatus for converting a solid carbonaceous material feed into liquid fuels, comprising:

a. a direct liquefaction reactor for directly converting such solid carbonaceous material at elevated temperatures and pressures in the presence of a solvent and a catalyst for producing hydrocarbon products;

b. a fractionator system for separating hydrocarbon products of said direct coal liquefaction reactor into different boiling point fractions, including a nominal 650° F.+ (343° C.+) fraction and a nominal 650° F. to 1000° F. (343° C. to 538° C.) fraction;

c. a slurry mix tank for mixing a portion of said nominal 650° F.+ (343° C.+) fraction and at least a portion of said nominal 650° F. to 1000° F. (538° C.) fraction with feed solid carbonaceous material to form a slurry;

d. a pump and conduit for feeding the slurry produced in the slurry mix tank directly to the input of said direct liquefaction reactor; and e. a heat exchanger connected to receive hydrogen recycled from said direct liquefaction reactor and/or makeup hydrogen for preheating such received hydrogen separately from said slurry and connected to the input of the direct liquefaction reactor for feeding the preheated hydrogen thereto for raising the temperature of the combined slurry and hydrogen being fed to the input of the direct liquefaction reactor to at least about 660° F.

* * * * *